US005215289A

United States Patent [19]

Jacobson

[11] Patent Number: 5,215,289

[45] Date of Patent: Jun. 1, 1993

[54] TRAILER LIFTING DEVICE

[76] Inventor: Jan E. F. Jacobson, 4045 Xerxes Ave., Minneapolis, Minn. 55410

[21] Appl. No.: 876,748

[22] Filed: Apr. 29, 1992

[51] Int. Cl.[5] ..... B66F 7/22

[52] U.S. Cl. ..... 254/422; 254/94

[58] Field of Search ..... 254/45, 94, 422; 280/300–304, 293, 297–299; 248/354.4, 407, 188.5

[56] References Cited

U.S. PATENT DOCUMENTS

| | | | |
|---|---|---|---|
| 2,108,888 | 2/1938 | Gunter | 254/422 |
| 3,733,051 | 5/1973 | Bollinger | 254/94 |
| 3,881,746 | 5/1975 | Newcomb | 254/94 |
| 3,951,383 | 4/1976 | Tenney | 254/94 |
| 4,580,804 | 4/1986 | Weber | 254/94 |

FOREIGN PATENT DOCUMENTS

| | | | |
|---|---|---|---|
| 697910 | 11/1930 | France | 254/94 |

*Primary Examiner*—Robert C. Watson
*Attorney, Agent, or Firm*—Hugh D. Jaeger

[57] ABSTRACT

An axle mounted trailer lifting device has a main body including a mounting mechanism at one end and a strut extending from the end opposite the mounting mechanism. The strut is pivotally mounted within the main body. When lifting the trailer is desired, to fix a flat tire or other malfunction, the strut may be moved by rearward motion on the trailer from a rest position, where it does not contact the ground, to an operative position, where it comes to rest within the main body in contact with the ground at an angle of less than 90 degrees. The main body and strut are configured to permit locking the strut in either of these two positions. The mounting end of the device is mounted to the trailer axle or other portion of the trailer. This device may also be used in conjunction with automobiles or other motorized vehicles.

8 Claims, 9 Drawing Sheets

TRAILER LIFTING DEVICE

BACKGROUND OF THE INVENTION

1. Field of the Invention

This invention relates generally to automotive or vehicle lifting devices, and more particularly concerns, a lifting device for a trailer which lifts the trailer such that the tires clear the ground, allowing the user to fix flat tires or other malfunctions on a site, safely, easily and quickly.

2. Description of Prior Art

Flat tires and other related malfunctions have been hazards of ground transportation since inflatable tires were first introduced. As with automobiles, trailers also employ inflatable tires which on occasion become flat or suffer other malfunctions, temporarily disabling the trailer. Once a flat tire or other malfunction occurs, the trailer has to be lifted off the ground such that its tires clear the ground, permitting the repair person to unbolt and remove the disabled wheel and replace it with a spare tire or other suitable functional wheel without jeopardizing personal safety.

Typically, hydraulic jacks are brought by repair vehicles to the site of the flat tire or other malfunction. There jacks, lift the trailer off the ground, permitting the flat tire to be repaired properly and safely.

There are several drawbacks in fixing a flat tire this way. Initially, not every trailer is equipped with a hydraulic jack, for they occupy large amounts of space, are bulky, and are rather expensive. When a flat tire occurs at a remote location, a hydraulic jack must be brought to the site of the flat tire, and operated by skilled personnel. Accordingly, bringing a crew with a hydraulic jack to a remote location to fix a flat tire or other malfunction is quite costly, involving substantial time delays and expenses.

Manually powered hand cranked jacks, usually found as standard equipment in motor vehicles, also exist to assist in repairing flat tires or other malfunctions. These jacks operate by lifting a vehicle at the frame. Specifically, these jacks are designed to lift vehicle frames located along the periphery of the vehicle.

In many trailers, the frame is inward from the periphery of the trailer. As a result, these manually powered jacks cannot reach the trailer frame due to their design limitations. Improperly using this manually powered jack to lift a trailer frame a substantial distance away from the periphery poses a serious safety risk to the repair person.

Lifting devices have also been mounted to vehicle axles. U.S. Pat. Nos. 1,343,845, 1,682,856, 1,955,649, 2,240,430 and 2,750,149 show some of these devices. Specifically U.S. Pat. No. 1,343,845 discloses an axle mounted hydraulic jack. U.S. Pat. Nos. 1,682,856, 1,955,649 and 2,240,430 disclose axle mounted mechanical jacks, while U.S. Pat. No. 2,750,149 discloses a mechanical jack of which only a portion is permanently mounted to the axle. The additional ground contacting segment is fitted within the permanently mounted portion immediately prior to use.

However, these prior art jacks exhibit a drawback in that they are oriented perpendicular to the ground. As a result of this perpendicular orientation, they are unstable. If any substantial forces are placed on the vehicle, the jack will collapse, damaging the vehicle, and possibly injuring the repair person. Therefore, a person must repair the flat tire with extreme care. Additionally, the jacks disclosed in U.S. Pat. Nos. 1,955,649 and 2,750,149 require blocks to initially elevate the vehicle prior to its retention in the elevated position by the jack.

SUMMARY OF THE INVENTION

The general purpose of the present invention is a trailer lifting device which is extremely stable and will not collapse upon the application of substantial force on the trailer, thus creating a safer workspace for the repair person. This trailer lifting device does not require any external devices to assist in elevating the trailer, as rearward motion of the trailer enables this device to lift the trailer off of the ground.

This trailer lifting device permits lifting of a fully loaded trailer, with little if any slippage or shifting of the load. The person operating the present invention does not need any special skills or training.

According to our embodiment of the present invention, there is provided a trailer lifting device including a main body with an end for attaching it to an axle or other portion of the trailer frame. A strut is pivotally mounted in the main body and extends from it at the end opposite the axle attaching end. When not in use, the strut is locked in a position substantially parallel to the ground. Upon use, this strut is released whereby it falls into contact with the ground. The rearward motion of the trailer moves it to an operative position, as the strut comes to rest against the axle. In this position, the strut is oriented to the ground at an acute angle, and the tire is off of the ground. The strut is then locked in this operative position while the flat tire or malfunction is repaired. Once the repair is complete, the strut is unlocked and the trailer is moved forward such that its tires again contact the ground. The strut is then moved upward, out of contact with the ground, and locked in the inoperative position until needed again.

It is one object of the invention to provide a trailer lifting device, mounted to a portion of a trailer, which can assist in lifting the trailer tires off the ground, quickly and easily in order to repair a flat tire or other malfunction on site.

It is one object of the invention to provide a trailer lifting device which can lift a loaded trailer with very little if any slippage or shifting of the load.

It is another object of the invention to provide a device mounted to a portion of a trailer that will elevate the trailer without the assistance of additional lifting devices in order to repair a flat tire or other malfunction with the trailer on site.

It is an additional object of the invention to provide a lifting device which can be operated by a person lacking any special skills or training.

It is further another object of the present invention to provide a lifting device mounted to a portion of a trailer that will elevate the trailer to a stable configuration enabling the repair person to operate with greater safety.

It is yet another object of the invention to provide a lifting device that is sturdy and simply constructed of very few pieces.

It is yet a further object of the invention to provide a lifting device mounted to the vehicle and capable of repeated uses if necessary.

Other objects and advantages of the invention will become apparent upon reading the following detailed description and appended claims, and upon reference to the accompanying drawings.

BRIEF DESCRIPTION OF THE DRAWINGS

For a more complete understanding of this invention reference should now be had to the embodiments illustrated in greater detail in the accompanying drawings and described below by way of example of the present invention, as may be applied to a trailer lifting device.

DETAILED DESCRIPTION OF THE PREFERRED EMBODIMENTS

Figure 1:
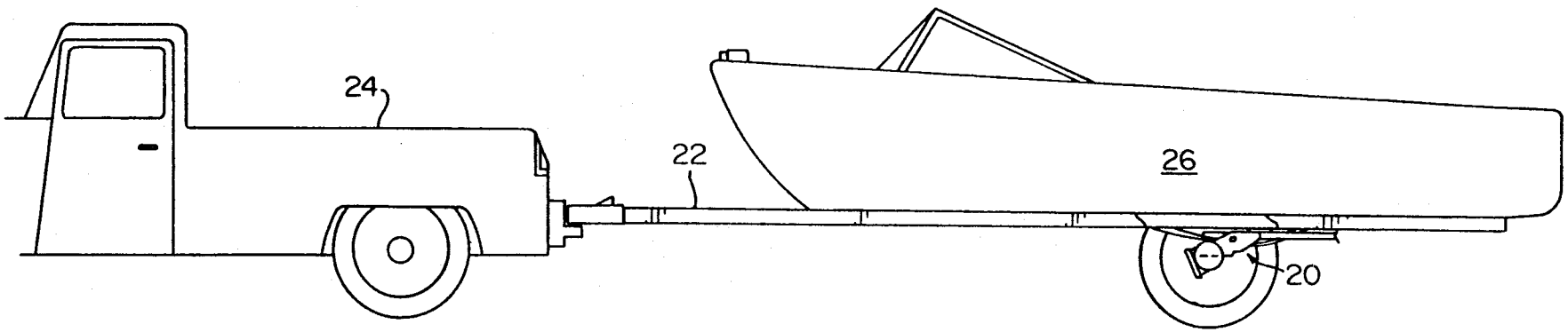
FIG. 1 is a side view of the invention in use on a trailer.

Turning to FIG. 1, there is shown the lifting device 20 of the invention in use on a trailer 22. The lifting device 20 is in the inoperative position. Typically, a motor vehicle 24 tows this trailer 22 which carries a boat 26 or other load.

Figure 2:
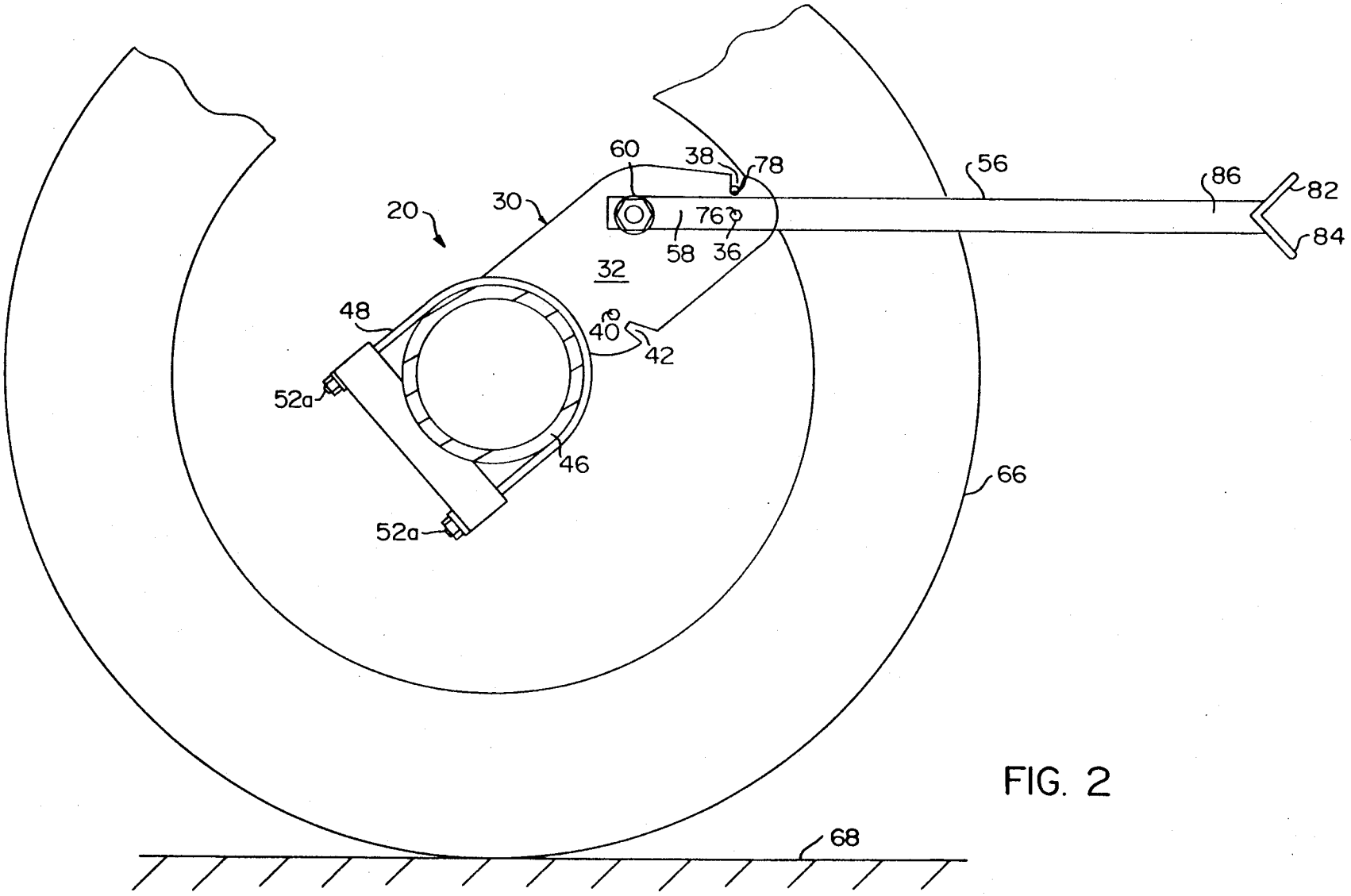
FIG. 2 is a side view of the trailer lifting device of the present invention with the strut locked in the inoperative position.
Figure 3:
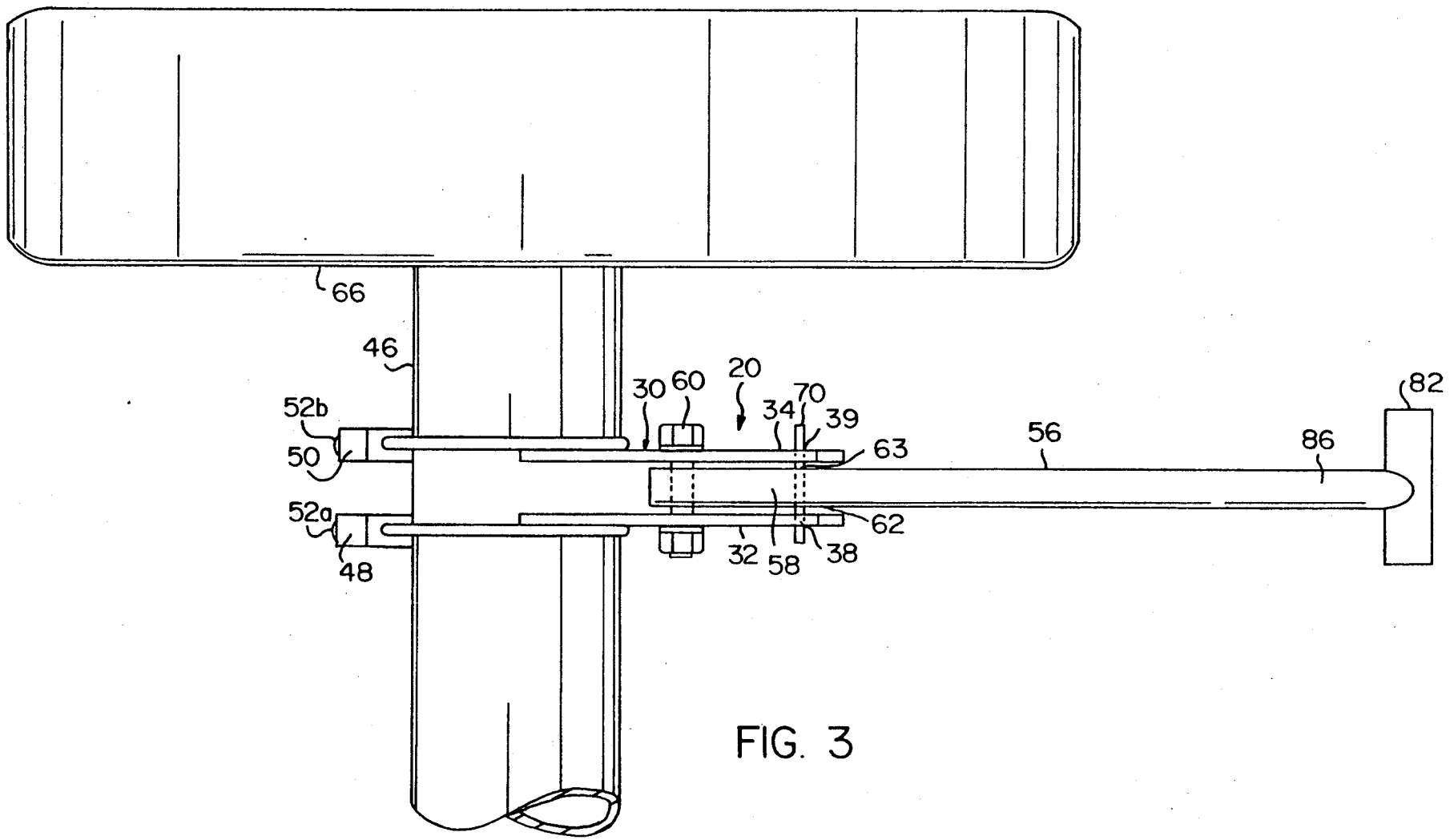
FIG. 3 is a top view of the trailer lifting device as shown in FIG. 2.

FIGS. 2 and 3 show the trailer lifting device 20 of the present invention in its inoperative position. The trailer lifting device 20 includes a main body 30 formed from two side pieces 32, 34. The main body 30 may also include a top piece connecting the two side pieces 32, 34. Both side pieces 32, 34 of the main body 30 include upper openings 36, 37 (See FIG. 6) and corresponding upper slots 38, 39 as well as lower openings 40, 41 (See FIG. 6) and corresponding lower slots 42, 43 (See FIG. 6). While the upper slots 38, 39 and the lower slots 42, 43 enhance locking (described below), such slots are not required. The preferred main body 30 is slightly angled in its design. This angling is a design choice based on the specific parameters of the trailer or vehicle undercarriage.

One end of the main body 30 is mounted to an axle 46 of the trailer (not shown) by brackets 48, 50 which are attached to the each of the side pieces 32, 34 of the main body 30. Bolts **52*a*, 52*b* secure the brackets 48, 50 to the axle 46. Alternately, the main body 30 may be mounted to the axle 46 or any other portion of the trailer (not shown) including the frame by brackets 48, 50** or any other conventional mounting device.

Preferably, two lifting devices are used for a single trailer, one positioned on the axle 46 proximate to each wheel. These two lifting devices mounted on the axle 46 should be used simultaneously, regardless of the side where the flat tire or other malfunction is located. Simultaneous use provides a uniform ground clearance and maximum stability for the system. However, in emergency situations, only one of the two devices has to be operated in order to lift the trailer. Finally, a single lifting device mounted anywhere on the axle 46 is also permissible.

A strut 56 extends from the other end of the main body 30. The upper end 58 of the strut 56 is pivotally mounted between the side pieces 32, 34 of the main body 30 by a bolt mechanism 60. This bolt mechanism 60 serves to connect both of the side pieces 32, 34 which form the main body 30. The pivotally mounted bolt mechanism 60 may be a single bolt or two separate bolts on each side of the strut 56 and the corresponding side pieces 32, 34. Alternatively, other suitable fastening devices capable of permitting pivoting may be used. The strut 56 includes openings 62, 63, which are designed to align with those openings 36, 37, 40, 41 in the main body 30, when the strut 56 is in the inoperative and operative (FIGS. 5 and 6) positions enabling it to be locked in the main body 30 in these positions.

In this inoperative position, the trailer tires 66, remain on the ground 68. The strut 56 is locked by a pin 70 placed through the cooperatingly aligned openings 36, 37, 62, 63 in the main body 30 and the strut 56 respectively. The strut 56 is locked in an orientation substantially parallel to the ground 68. Alternatively, the strut 56 may be oriented in any other direction, provided it does not impede or obstruct movement of the trailer. The strut 56 is of a substantial length such that is in the operative lifting position (FIGS. 5 and 6), it orients at an acute angle $\Theta$ with respect to the ground and permits the tires 66 on the trailer 22 (FIG. 1) sufficient ground clearance. This enables the repair person sufficient access to the trailer wheel 74 in order to properly repair it.

The preferred locking pin 70 is two pronged such that a first prong 76 extends through the cooperatingly aligned openings 36, 37 of the main body 22 and those corresponding openings 62, 63 in the strut 56. The second prong 78 engages the upper slots 38, 39 in both side pieces 32, 34 of the main body 30. When lifting the trailer is desired, this pin 70 is removed from the cooperatively aligned main body and strut openings 36, 37, 62, 63 and the upper body slots 38, 39. The strut 56 is now released and the trailer (not shown) may be moved to the operative lifting position (FIGS. 5 and 6), where its tires clear the ground.

A single pronged pin, which does not engage the upper 38, 39 and lower 42, 43 slots in the main body 30, may also be used to lock the strut 56 into the inoperative and operative positions. Additionally, other locking means such as those engaging only the slots, tying the strut with chains, snap together arrangements, or other suitable holding mechanisms may be used.

Plates 82, 84 are disposed at the lower end 86 of the strut 56. When the strut 56 is in the intermediate (FIG. 4) or operative (FIGS. 5 and 6) positions, these plates 82, 84 increase the amount of surface area in contact with the ground 68, providing the lifting device 20 with enhanced stability. While these plates 82, 84 preferably attach to the strut 56 in the form of a right angled inverted "V", the plates 82, 84 may be in other configurations. Alternately, plates 82, 84 are not required. Absent these plates 82, 84 the lower end 86 of the strut 56 may be squared, rounded or beveled to conform with the angle $\Theta$ assumed by the strut 56 with respect to the ground 68 when it is locked in the operative position (FIGS. 5 and 6).

Figure 4:
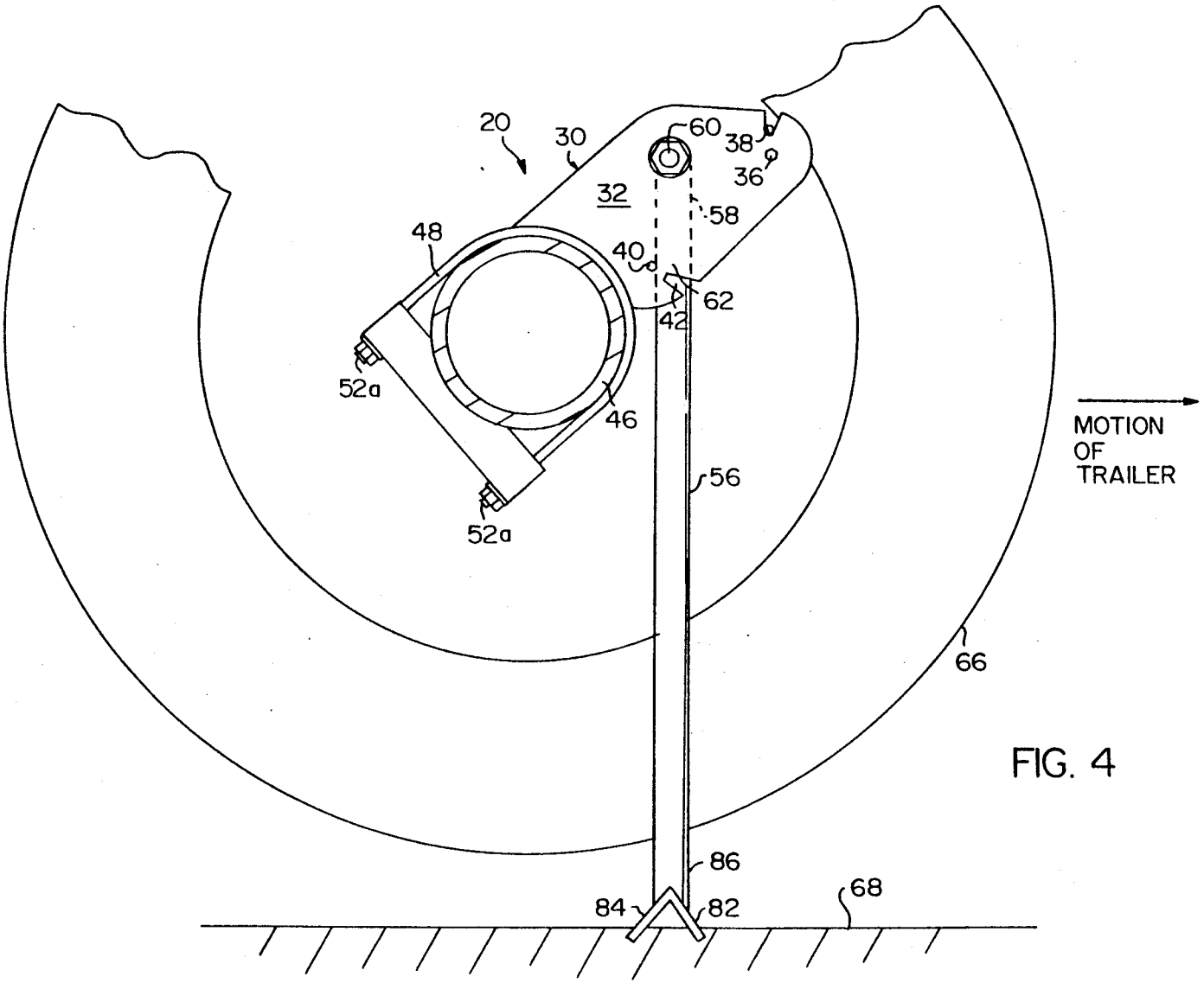
FIG. 4 is a side view of the trailer lifting device of the present invention with the strut in an intermediate position where the trailer tires have been lifted off of the ground.

FIG. 4 shows the trailer lifting device 20 with its strut 56 unlocked. Lifting the trailer is in progress as it is moved rearward (indicated by the arrow). Specifically, the strut 56 has moved to an intermediate position where it is approximately perpendicular to the ground 68. At this time the trailer tires 66 are raised above the ground 68, as rearward movement continues.

Figure 5:
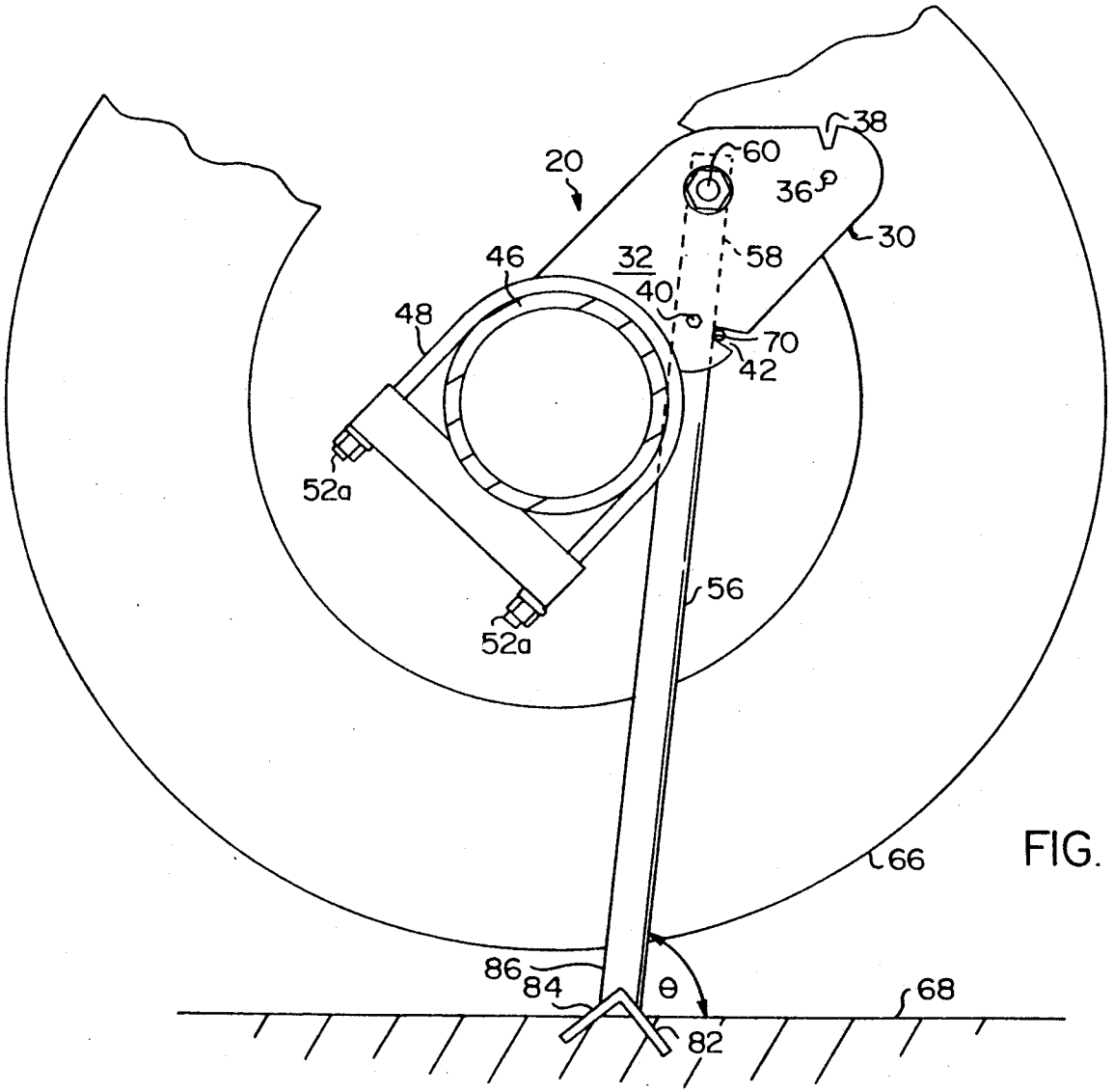
FIG. 5 is a side view of the trailer lifting device of the present invention with the strut locked in its operative position.
Figure 6:
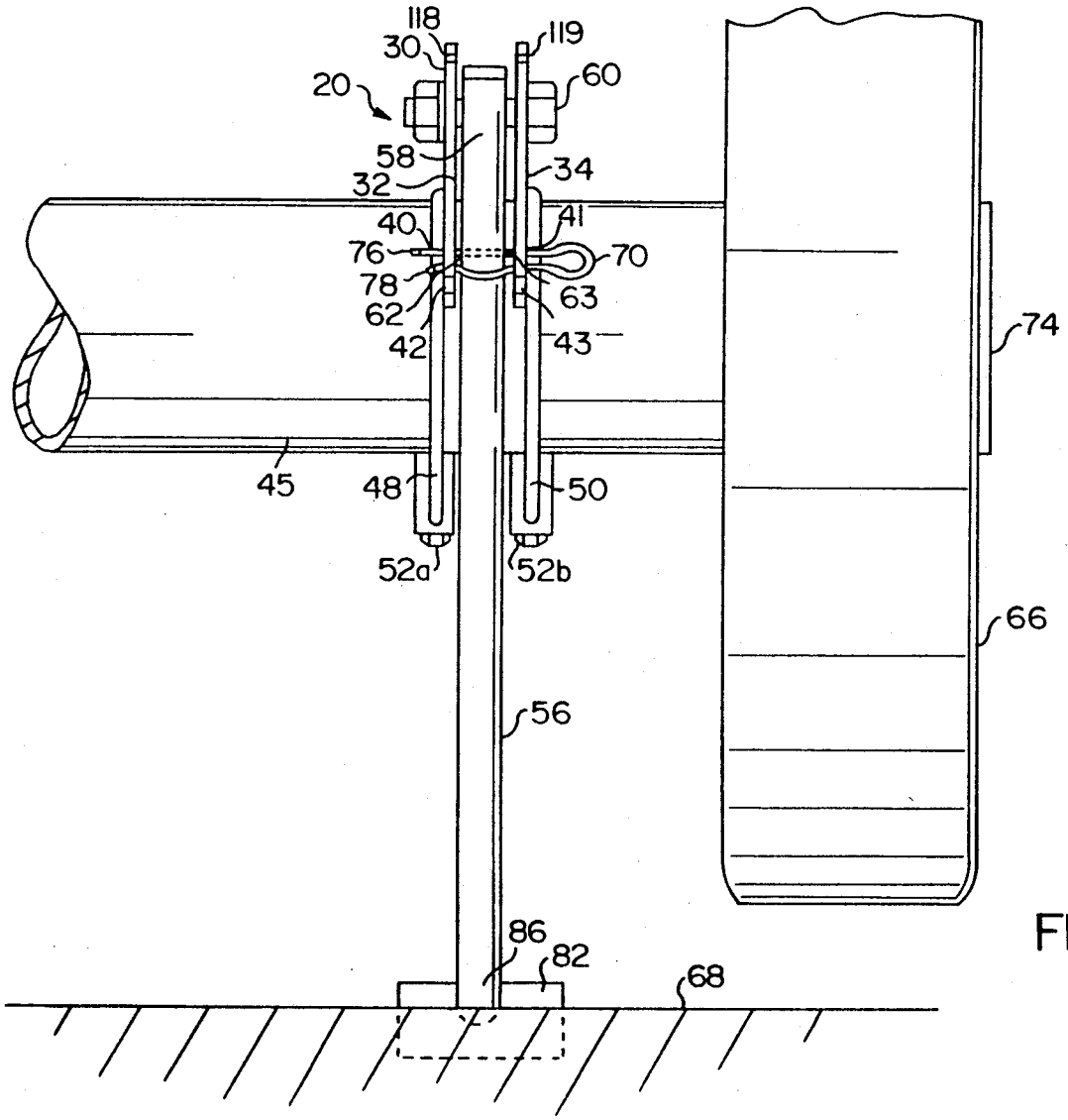
FIG. 6 is a front view of the trailer lifting device as shown in FIG. 5.

Turning now to FIGS. 5 and 6, the continued rearward movement of the trailer has caused the strut 56 to abut against the axle 46 such that its movement ceases. The strut 56 is now at rest in the operative position as the tire(s) 66 is off of the ground 68. In this position, the strut 56 is oriented at an acute angle 8 with respect to the ground 68. The main body lower openings 40, 41 and strut openings 62, 63, are again cooperatively aligned. The two pronged pin 70, may now be placed in the main body 30 such that its first prong 76 is inserted into and through the cooperatingly aligned lower openings 40, 41 in the main body 30 and the strut openings 62, 63. The second prong 78 engages the lower slots 42, 43 in the main body 30. The strut 56 is now locked in the operative position.

Due to the weight of the trailer, the plates 82, 84 grip or slightly entrench in the ground 68. The extra surface area of the plates 82, 84 combined with the acutely angled strut 56, provides firm, stable support for the trailer 22 (FIG. 1). As a result of the enhanced stability of this device, the repair person works in a safer space, as only substantial forces are capable of collapsing this lifting device.

In this preferred design, the axle 46 serves as a stop, preventing further movement of the strut 56. However, other suitable stops may be employed in the main body 30 for this purpose. For example, stops consisting of metal wedges may be mounted on the inside of the side pieces 32, 34 of the main body 30. These stops would prevent additional movement of the strut 56.

The lifting device 20 is rugged and may be used repeatedly. It is preferably made of metal, such as iron, stainless steel or other suitable strength metals which can support both a loaded or unloaded trailer. High strength polymers may also be used.

Figure 7:
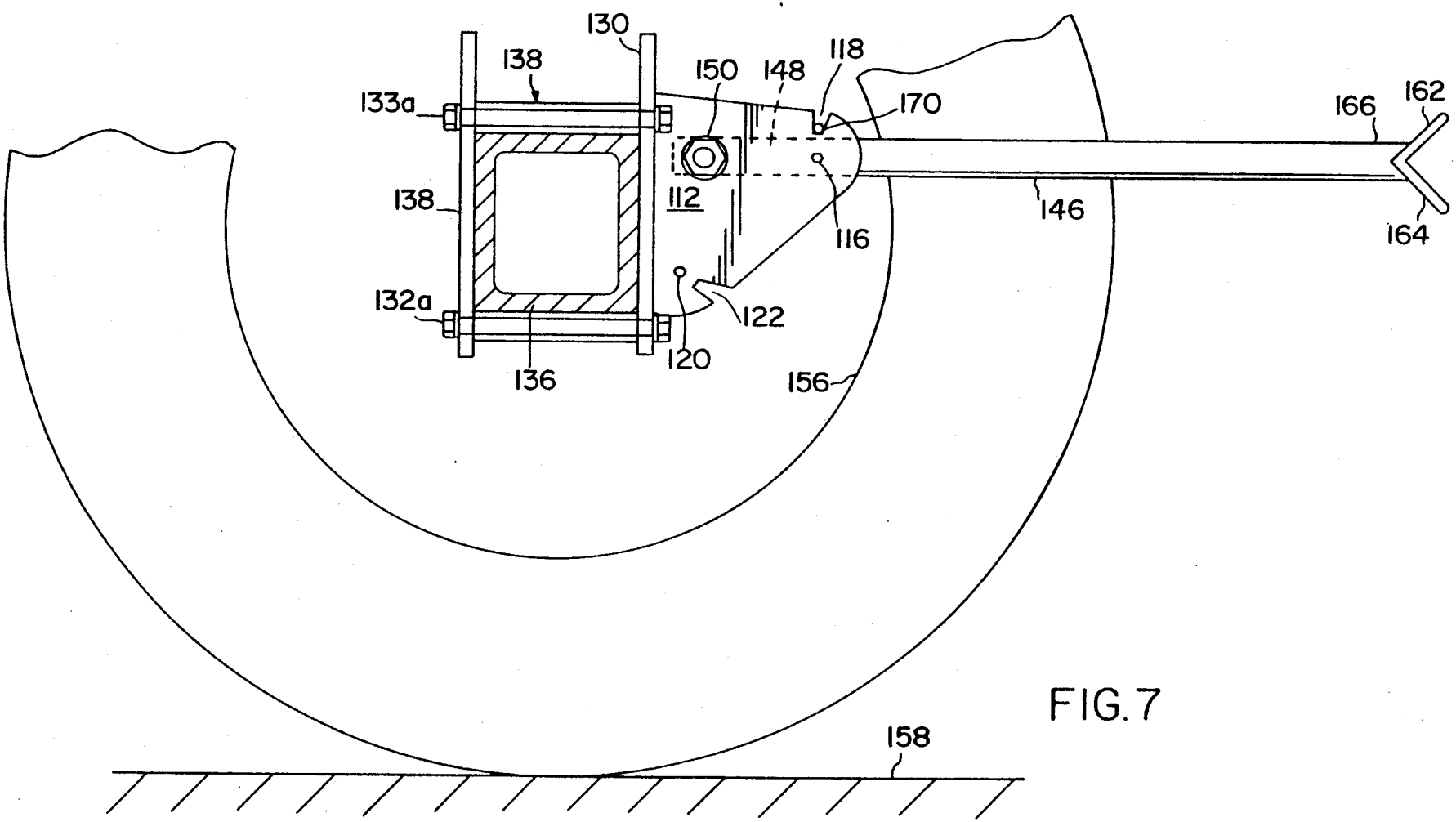
FIG. 7 is a side view of a second embodiment of the trailer lifting device of the present invention with the strut locked in the inoperative position.
Figure 8:
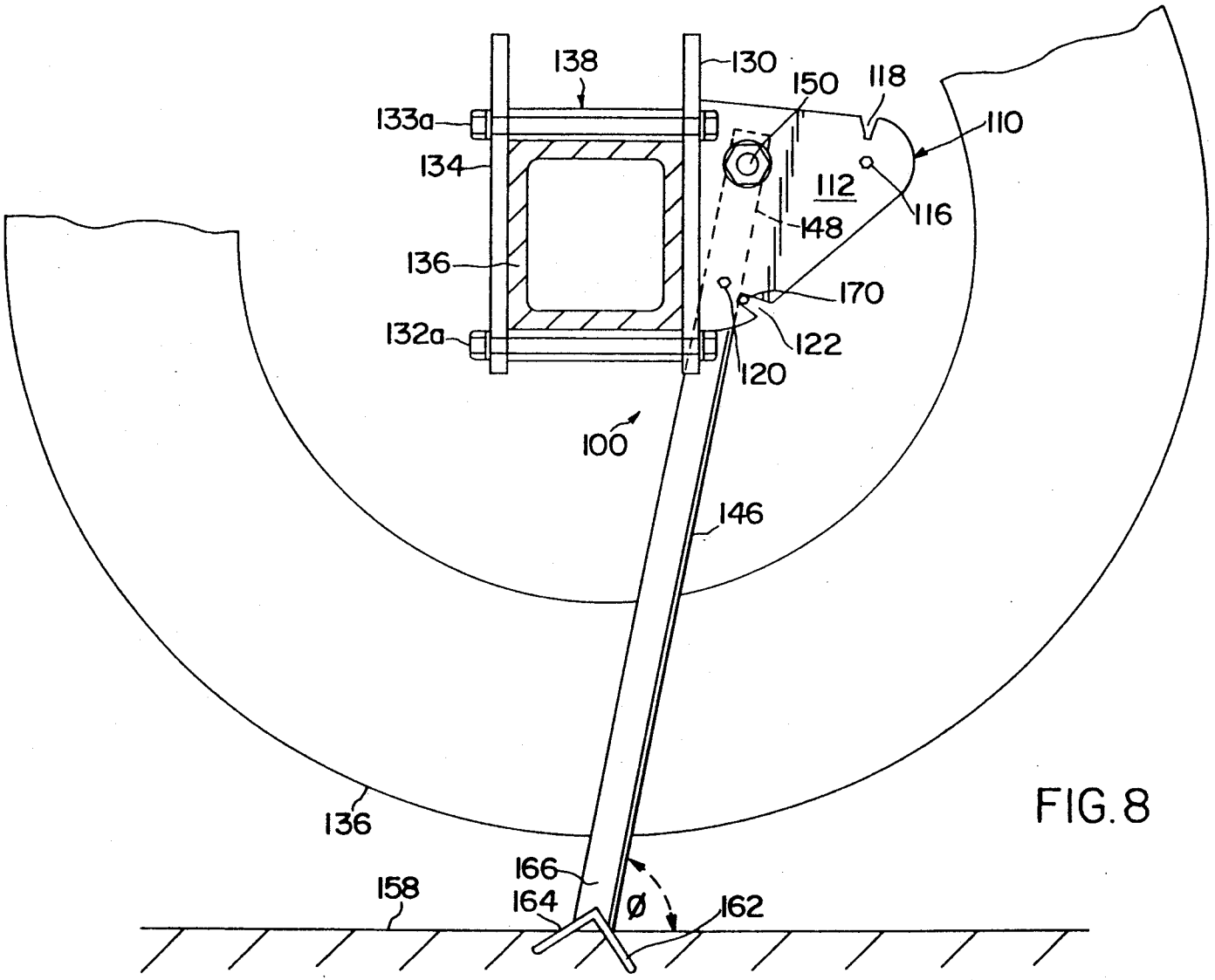
FIG. 8 is a side view of the trailer lifting device of the present invention with the strut locked in its operative position.
Figure 9:
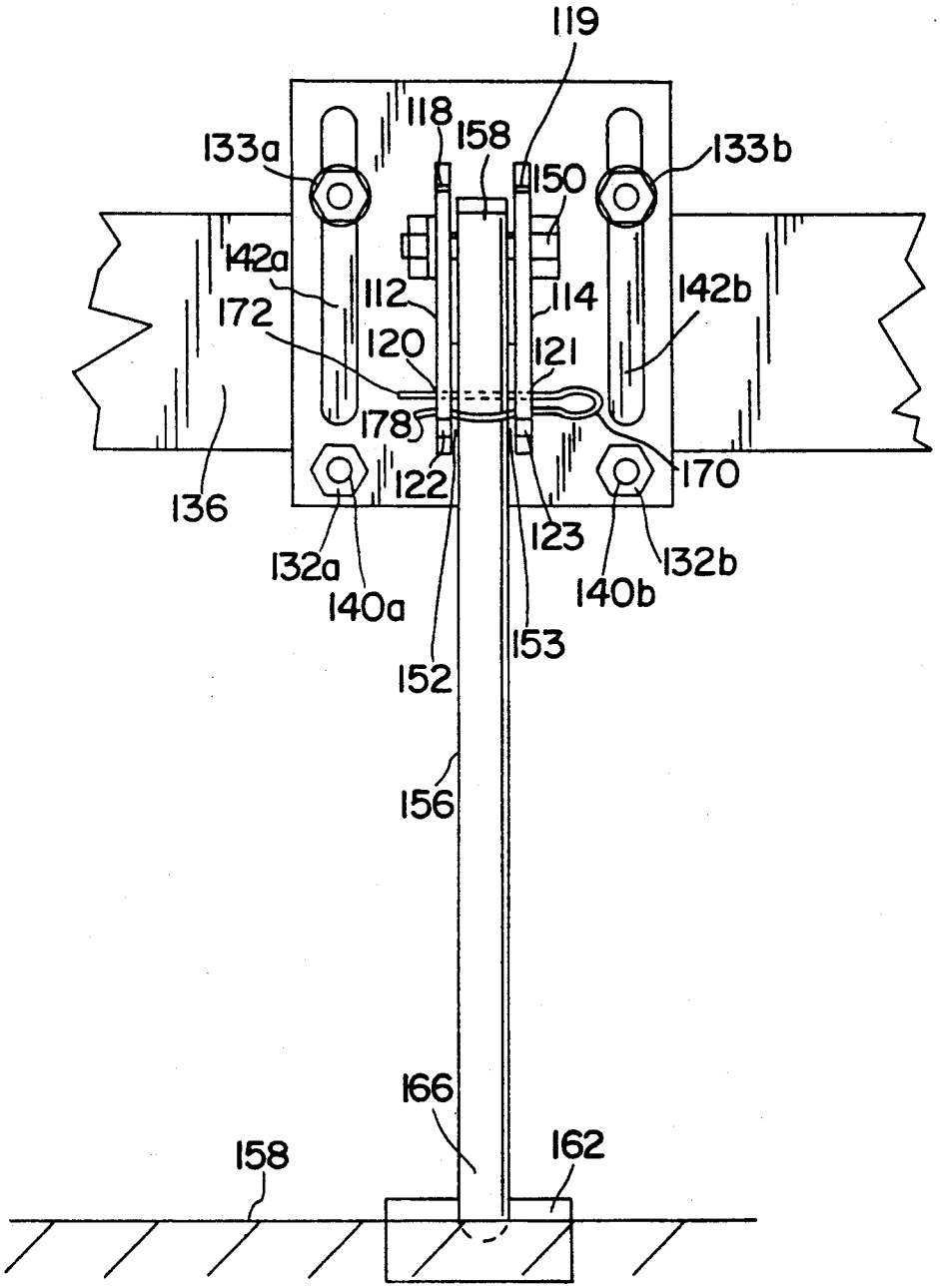
FIG. 9 is a rear view of the trailer lifting device as shown in FIG. 8.

Referring to FIGS. 7–9 there is shown a second embodiment of the trailer lifting device 100 of the invention. This embodiment is particularly adapted for square axles. Otherwise, this second embodiment is similar in structure and function to the first embodiment.

The device 100 includes a main body 110 formed of two side pieces 112, 114. Both side pieces 112, 114 include an upper opening 116 (opposite upper opening exists but is not shown) with corresponding upper slots 118, 119 along with a lower opening 120, 121 and corresponding lower slots 122, 123. While these upper 118, 119 and lower 122, 123 slots are preferred for enhanced locking, they are not required. The main body 110 may be slightly angled in its design to accommodate various trailer design parameters.

The side pieces 112, 114, which form the main body 110, are attached at one end of the main body 110, preferably by welds to a bolt receiving plate 130. This bolt receiving plate 130 preferably receives four bolts 132*a*, 132*b*, 133*a*, 133*b* which are attached to an oppositely disposed plate 134. Both plates 130, 134 abut opposite sides of the square axle 136, forming a clamp-like bracket 138. The bolt receiving plate 130 is preferably designed to receive two bolts 132*a*, 132*b* in fixed positions 140*a*, 140*b* and two bolts through oblong openings 142*a*, 142*b*. These oblong openings 142*a*, 142*b* permit greater clamping and adjustability for the plates 130, 134 around the square axle 136, resulting in a firm stable mount. While four bolts, 132*a*, 132*b*, 133*a*, 133*b* at the corners of the plates 130, 134, are preferred, as few as two bolts may be used provided the plates 130, 134 are designed accordingly.

A strut 146 extends from the other end of the main body 110. The upper end 148 of the strut 146 is pivotally mounted between the side pieces 112, 114 of the main body 110 by a bolt mechanism 150. This bolt mechanism 150 serves to connect both of the side plates 112, 114 which form the main body 110. The pivotally mounted bolt mechanism 150 may be a single bolt or two separate bolts on each side of the strut 146 and the corresponding side pieces 112, 114. Alternatively, other suitable fastening devices capable of permitting pivoting may be used. The strut 146, includes openings 152, 153, which are designed to align with the upper 116, 117 and lower 120, 121 openings in the main body, when the strut 146 is in the inoperative (FIG. 7) and operative (FIGS. 8 and 9) positions, enabling it to be locked in the main body 110 in these positions.

Plates 162, 164 are disposed at the lower end 166 of the strut 146. These plates 162, 164 increase the amount of surface area in contact with the ground. When the strut 146 is in the operative position (FIGS. 8 and 9) the plates 162, 164 grip or entrench in the ground 158 to provide the lift device 100 with enhanced stability. While a strut 146 with plates 162, 164, attached in the form of a right angled inverted "V" is preferred, the plates 162, 164 may be in other configurations. Alternately, plates 162, 164 are not required. Absent these plates 162, 164, the lower end 166 of the strut 146 may be squared, rounded or beveled to conform with the acute angle $\phi$ assumed by the strut 146 when it is locked in the operative position (FIGS. 8 and 9).

Similar to the embodiment described in FIGS. 1–6, in the inoperative position illustrated in FIG. 7, the trailer tires 156 are on the ground 158. The strut 146 is locked When movement to the operative position shown in FIGS. 8 and 9 is desired, it is done in a manner identical to that disclosed for the first embodiment.

Turning specifically to FIGS. 8 and 9, the continued rearward movement of the trailer (not shown) has caused the strut 146 to abut against the bolt receiving plate 130 whereby its movement ceases. The strut 146 is now in the operative position as the tire(s) 156 has been lifted off the ground 158. In this position, the strut 146 is oriented at an acute angle $\phi$ with respect to the ground 158. The main body lower openings 120, 121 and strut openings 152, 153 are again cooperatively aligned. A two pronged pin 170 may now be placed in the main body 110 such that its first prong 172 is inserted into and through the cooperatingly aligned lower openings 120, 121 in the main body 110 and the strut openings 152, 153. The second prong 174 engages the lower slots 122, 123 in the main body 110. The strut 146 is now locked in the operative position. Other locking devices which engage only the cooperatively aligned openings 120, 121, 152, 153 or the slots 122, 123 are permissible.

While the two preferred embodiments disclose trailer lifting devices, these lifting devices could also be mounted on motor vehicles such as automobiles and trucks, other wheeled devices and the like, on the axle, frame or at any other position on the vehicle which could support such a lifting device. Modifications, when necessary, could easily be made to accommodate the design parameters of the various vehicles. Accordingly, the lifting device of the present invention, if placed on these other vehicles, would operate identically to that which has been disclosed for trailers.

MODE OF OPERATION

The preferred mode of operation involves a trailer having two lifting devices of the invention, mounted on the trailer axle proximate to each wheel. Both lifting devices are operated simultaneously, even though reference is made to a single lifting device.

Initially, the strut is positioned within the main body and locked in the inoperative position above the ground. In this position, the strut is substantially parallel to the ground. When lifting is desired due to a flat tire or other malfunction, a pin which locks the strut within the main body in the inoperative position is released such that the lower end of the strut contacts the ground. At this time, the trailer is moved rearward such that the strut moves to an acute angle with respect to the ground. Movement of the strut ceases when it abuts the axle. This can be felt by the vehicle operator who subsequently stops moving the vehicle rearward. The tire is now off of the ground and the strut is locked in this operative position as the pin is placed through cooperatively aligned openings and slots in the main body and the strut.

Once the flat tire or other malfunction has been repaired, the pin is released from the main body and the strut. The trailer is moved forward such that its tires resume contact with the ground. The forward movement of the trailer continues until the strut is no longer entrenched in the ground and can be easily lifted upward to the inoperative position. Once openings in the strut and main body are aligned, the strut is locked in the main body in this inoperative position as a pin is placed through these cooperatingly aligned openings and slots. This procedure may be repeated if the necessity arises.

From the foregoing it will be seen there has been brought to the art a new and improved lifting device which overcomes the problems associated with the prior art vehicle mounted jacks. The present invention overcomes the drawbacks of these prior art systems through the presence of an axle mounted lifting device which locks at an acute angle with respect to the ground. While particular embodiments of the invention have been shown, it will be understood, of course, that the invention is not limited thereto since various modifications may be made to the present invention without departing from the apparent scope hereof. This is especially true for those skilled in the art, particularly in light of the foregoing teachings. It is, therefore, contemplated by the appended claims to cover any such modifications as incorporate those features which constitute the essential features of these improvements within the true spirit and the scope of the invention.

What is claimed is:

1. A vehicle lifting device comprising:

a. a main body for mounting on a transverse vehicle member for extending away from the vehicle member in a first direction in which the vehicle moves;

b. a strut having a first end pivotally mounted to the main body at a point above the vehicle member and spaced apart from the vehicle member in the first direction and having a second ground engaging end; and, c. a strut being movable from a first inoperative position to a second operative ground-engaging position in which a strut rests against the vehicle member and meets the ground at an acute angle.

2. The lifting device of claim 1 wherein the vehicle member is a frame member.

3. The lifting device of claim 1 wherein the vehicle member is an axle.

4. The lifting device of claim 1 wherein the main body includes a pair of plates mounted on a transverse vehicle member and wherein the strut is pivotally mounted between the plates.

5. The vehicle lifting device of claim 1 further including means for locking the strut in the main body in either the first or second position.

6. The vehicle lifting device of claim 5 wherein the means for locking includes:

a. an opening in the strut and a pair of openings in the body, each of the openings in the body corresponding to one of the first and second strut positions; and, b. a pin for insertion through the opening in the strut and one of the selected openings in the main body.

7. A trailer lifting device comprising:

a. a main body including first and second plates bolted to a horizontal vehicle member which is transverse to the direction of travel of the vehicle, the plates including a portion higher than the transverse vehicle member and extending away from the vehicle member in a first direction of travel of the vehicle;

b. a strut pivotally mounted between the plates at a point above the vehicle member and spaced apart from the vehicle member in a first direction; and, c. a strut having a first inoperative position in which it is not in contact with the ground and a second ground-engaging position in which the strut is pivoted downward to rest against the transverse vehicle member, thereby lifting the vehicle from the ground as the strut rests against the ground at an acute angle.

8. A method of lifting a trailer for service comprising:

a. attaching a main body of a trailer lifting device to a transverse frame member so that the body extends above the frame member and to the rear of the frame member;

b. pivotally mounting a strut on the main body at a point higher than the frame member and rearward of the frame member at a point closer to the ground then a length of the strut;

c. pivoting the strut downward to meet the ground;

d. backing the trailer in a rearward direction so that the strut engages the ground and pivots to lift the trailer from the ground; and, e. backing the trailer until the strut stops by contacting the frame member and meets the ground at an acute angle.

* * * * *